US006467112B1

(12) United States Patent
Cheng

(10) Patent No.: US 6,467,112 B1
(45) Date of Patent: Oct. 22, 2002

(54) OPERATING TABLE FOR ANIMAL

(75) Inventor: Henrich Cheng, Taipei (TW)

(73) Assignee: Veterans General Hospital-Taipei, Taipei (TW)

( * ) Notice: Subject to any disclaimer, the term of this patent is extended or adjusted under 35 U.S.C. 154(b) by 13 days.

(21) Appl. No.: 09/695,047

(22) Filed: Oct. 25, 2000

(30) Foreign Application Priority Data

Oct. 26, 1999 (TW) ..... 88218185

(51) Int. Cl.[7] ..... A61G 13/00
(52) U.S. Cl. ..... 5/606; 5/600
(58) Field of Search ..... 5/606, 600, 604; 108/24; 454/49; 119/753

(56) References Cited

U.S. PATENT DOCUMENTS 188,568 A * 3/1877 Beaman ..... 108/24
445,327 A * 1/1891 De Barr ..... 4/530
1,039,708 A * 10/1912 Denquer ..... 5/606
1,201,274 A * 10/1916 Denquer ..... 5/606 X
3,358,579 A * 12/1967 Hauville ..... 454/58
3,715,972 A * 2/1973 Kelso et al. ..... 454/61
3,757,356 A * 9/1973 Freeman ..... 4/456
3,894,480 A * 7/1975 Birdsall et al. ..... 454/49
4,243,214 A * 1/1981 LaRooka ..... 5/606 X
4,620,333 A * 11/1986 Ritter ..... 5/695
4,635,913 A * 1/1987 Rothman ..... 5/658
4,650,171 A * 3/1987 Howorth ..... 5/600
4,718,653 A * 1/1988 Rothman ..... 5/606 X
4,811,937 A * 3/1989 Rothman ..... 5/606
4,843,690 A * 7/1989 Iacobucci et al. ..... 5/606 X
4,870,710 A * 10/1989 Hartmann ..... 5/606
D306,100 S * 2/1990 Wende ..... 108/24 X
4,898,089 A * 2/1990 Roos ..... 454/49
4,901,410 A * 2/1990 Fischer et al. ..... 27/21.1
5,244,433 A * 9/1993 Utterback ..... 5/606 X
6,279,510 B1 * 8/2001 Batterton ..... 119/753

* cited by examiner

*Primary Examiner*—Robert G. Santos
(74) *Attorney, Agent, or Firm*—Bacon & Thomas, PLLC

(57) ABSTRACT

An operation table. The table includes table top and a sink mounted under the table top. The sink is provided at one end with a discharge port, and at other end with an opening which is provided with a cover plate having a ventilation hole, and a sink cover having through holes. When a surgical operation is carried out on the sink cover, the waste fluids of the surgical operation are collected in the sink via the through holes of the sink cover such that liquid fluids are drained out via the discharge port of the sink, and gaseous fluids are drawn out of the sink via the ventilation hole which is fastened at one end of a ventilation pipe which is in turn fastened at another end with a pumping device.

15 Claims, 2 Drawing Sheets

OPERATING TABLE FOR ANIMAL

FIELD OF THE INVENTION

The present invention relates generally to an animal operation table, and more particularly to the animal operation table which is provided with a sink, a perforated sink cover, and a ventilation pipe.

BACKGROUND OF THE INVENTION

The conventional animal operation table is generally defective in design in that it is devoid of facilities which are designed to dispose the contaminated animal fluids, such as blood, and an anesthetic that is used in the surgery of an animal. Unless the contaminated animal fluids and the anesthetic are properly disposed of, they are prone to pollute the laboratory and the surgery room.

SUMMARY OF THE INVENTION

The primary objective of the present invention is therefore to provide an operating table for use by an operator or veterinarian to undertake the surgery of an animal in such a manner that the contaminated animal fluids and the anesthetic are easily and properly disposed of.

In keeping with the principle of the present invention, the foregoing objective of the present invention is attained by an animal operation table comprising mainly a table top, and a sink. The sink is located under the table top.

Said sink is provided at one end thereof with a discharge port, and at other end thereof with an opening which is provided with two portions, with one of said two portions being provided with a cover plate having a ventilation hole, and with other one of said two portions being provided with a sink cover having a plurality of through holes.

Said operating table further comprises a ventilation pipe connected to said ventilation hole, whereby a surgical operation of an animal can be carried out on said sink cover such that waste fluids produced in the surgical operation are collected in said sink via said through holes of said sink cover, and that liquid is drained out via said discharge port of said sink, and further that gas is drawn out of said sink by a pumping device via said ventilation pipe which is fastened at one end thereof with said ventilation hole, and at other end thereof with the pumping device.

The operating table of the present invention may further comprises a plurality of adjustable legs fastened to said table top for adjusting the height of the table top of the operating table, an electrical outlet, a faucet connector, an article holding area, a lighting source, a mechanical arm, and a cabinet. The sink cover is further provided with a hand grip.

Preferably, said sink, is of funneled construction, wherein said discharge port is located at a bottom end of said funneled sink and is provided with a casing fastened therewith. More preferably, said discharge port is provided with a filtration device for separating solid particles from a liquid.

Preferably, said ventilation pipe is provided with a control device for regulating the flow of the gaseous fluid in said ventilation pipe.

The through holes of the sink cover may be uniform in hole diameter. The through holes of the sink cover preferably are dimensioned in such a manner that those located in the proximity of the ventilation pipe are smaller in hole diameter than the rest of the through holes. The mechanical arm is intended to hold an auxiliary device, such as a microscope or magnifying lens. The hand grip of the sink cover may be fixed or detachable.

The table top of the present invention is provided with a raised portion extending along edges of the opening of the sink, such that the sink cover is lower in level than the raised portion of the table top, so as to confine the animal wasted liquid to the sink cover.

DETAILED DESCRIPTION OF THE EMBODIMENTS

Figure 1:
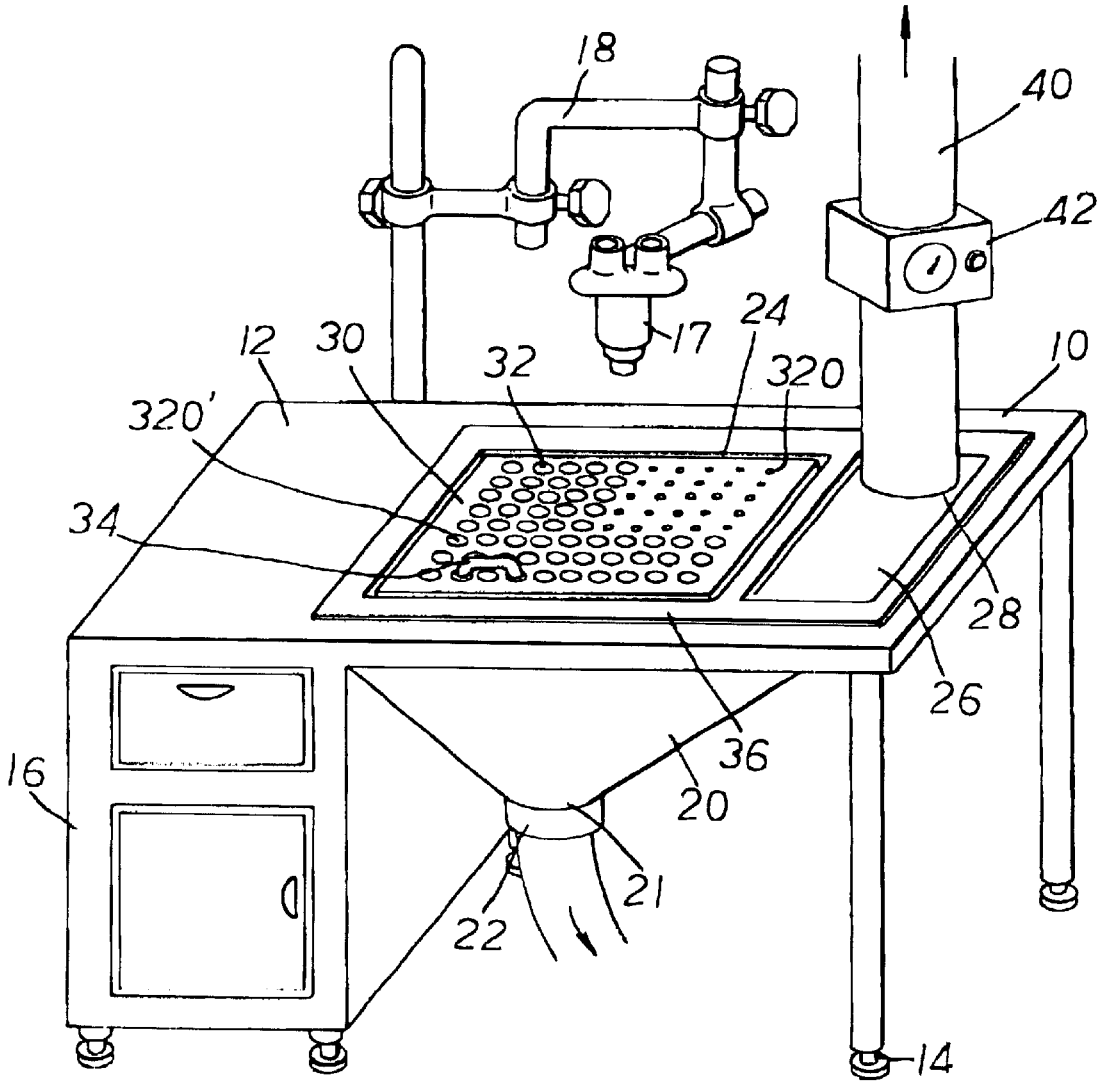
FIG. 1 shows a perspective view of a preferred embodiment of the present invention.
Figure 2:
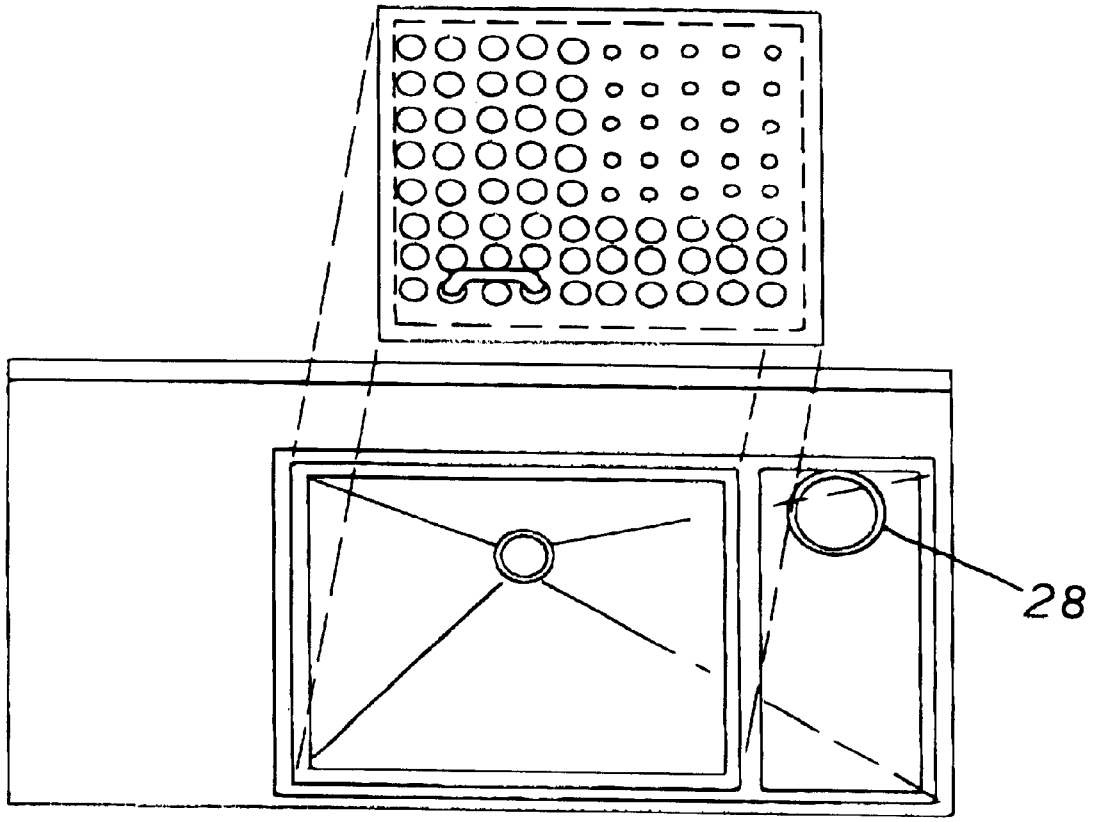
FIG. 2 shows a schematic top view of the sink and the sink cover of the preferred embodiment of the present invention.

As shown in FIGS. 1 and 2, an operating table of the preferred embodiment of the present invention is designed for use by an operator or veterinarian and is essentially composed of a table top 10, a sink 20 made of a stainless steel material, a perforated sink cover 30 made of a stainless steel material, and a ventilation pipe 40 made of a stainless steel material The sink 20 is of a funneled construction and is located under the table top 10. The sink 20 is provided at the bottom thereof with a discharge port 21, and at the top thereof with an opening 24. The discharge port 21 is connected with a drainpipe in conjunction with a casing 22 in which a filtration device (not shown in the drawing) is housed. The opening 24 of the sink 20 is in fact provided with two portions, with one portion being provided with a cover plate 26 of a stainless steel and having a ventilation hole 28, and with other portion being covered by the sink cover 30. The table top 10 is provided with a raised portion 36 extending along the four edges of the opening 24 of the sink 20 such that the sink cover 30 is lower in level than the raised portion 36 of the table top 10, so as to confine the animal waste liquid to the sink cover 30.

The sink cover 30 is provided with a plurality of through holes 32, on which a surgical operation is carried out. According to the hole diameter, there are small through holes 320 which are located in the proximity of the ventilation hole 28, and large through holes 320' which are greater in hole diameter than the small through holes 320 and are located away from the ventilation hole 28. The sink cover 30 is provided at the top surface thereof with a movable hand grip 34 of a stainless steel material. The hand grip 34 is of an inverted U-shaped construction and is provided with two legs, with each having an outer diameter smaller than the hole diameter of the large through holes 320'. The two legs of the hand grip 34 are retained in two of the large through holes 320', into where they are inserted and then were bent.

The ventilation pipe 40 is connected at one end thereof with the ventilation hole 28, and at other end thereof with a pumping device (not shown in the drawing). The ventilation pipe 40 is provided with a control device 42 for regulating the amount of a gas that is drawn out of the sink 20.

The table top 10 is provided with an article holding area 12, a plurality of adjustable legs 14, a cabinet 16, and a microscope 17 which is held by a mechanical arm 18. The table top 10 may be further provided with a lighting source (not shown in the drawings), an electrical outlet (not shown in the drawing), and a water source connector (not shown in the drawing).

As a surgical operation is started, the pumping device is started. The surgical waste matters, such as animal blood and anesthetic, are collected in the sink 20 via the through holes 32 of the sink cover 30. The liquid waste matters are drained out via the discharge port 21, whereas the solid waste matters are trapped by the filter located in the casing 22. The gaseous wasted matters are drawn out of the sink 20 by a pumping device (not shown) via the ventilation pipe 40. Upon completion of the surgical operation, the sink cover 30, on which the surgical operation is performed, is washed and rinsed. The waste water is drained out of the sink 20 via the discharge port 21 of the sink 20. The raised portion 36 is intended to confine the waste matters on the sink cover 30.

In light of the through holes 32 of the sink cover 30 being different in hole diameter, all areas of the sink cover 30 are equally effected by the suction force provided by the pumping device.

The sink cover 30 is detachably disposed in the opening 24 of the sink 20. The handgrip 34 is either fixed or detachable.

What is claimed is:

1. An operating table comprising:

a table top; and a sink mounted under the table top;

wherein said sink comprises a lower end having a discharge port, and an upper end having an opening, the opening comprises two portions, one of said two portions provided with a cover plate having a ventilation hole, and the other one of said two portions provided with a sink cover having a plurality of through holes, wherein said operating table further comprises a ventilation pipe directly connected to and positioned above said ventilation hole, such that surgical operation of an animal can be carried out on said sink cover whereby waste fluids produced during surgical operation are collected in said sink via said through holes of said sink cover, and liquid fluids from the waste fluids are drained out via said discharge port of said sink, and gaseous fluids from the waste fluids are drawn out of said sink by a pumping device via said ventilation pipe, the ventilation pipe is fastened at one end thereof with said ventilation hole, and at another end thereof with the pumping device.

2. The operating table as defined in claim 1, wherein said table top is provided with a plurality of height adjustable legs fastened thereto.

3. The operating table as defined in claim 1, wherein said sink comprises a funnel shape; and wherein said discharge port is located at a bottom end of said sink and is provided with a casing fastened therewith.

4. The operating table as defined in claim 1, wherein said discharge port is provided with a filtration device for separating solid particles from a liquid.

5. The operating table as defined in claim 1, wherein said ventilation pipe is provided with a control device for regulating the flow of the gaseous fluid in said ventilation pipe.

6. The operating table as defined in claim 1, wherein said through holes of said sink cover are uniform in hole diameter.

7. The operating table as defined in claim 1, wherein said through holes of said sink cover are different in hole diameter such that those located in the proximity of said ventilation hole are smaller in hole diameter than those are located away from said ventilation hole.

8. The operating table as defined in claim 1, wherein said table top is provided with an article holding area.

9. The operating table as defined in claim 1, wherein said table top is provided with a mechanical arm for holding an auxiliary device.

10. The operating table as defined in claim 9 wherein said auxiliary device is a microscope.

11. The operating table as defined in claim 1, wherein said table top is provided with a raised portion extending along edges of said opening of said sink such that said raised portion is higher in level than a top surface of said sink cover whereby said raised portion is able to confine the fluids from the waste to said sink cover.

12. The operating table as defined in claim 1, wherein said table a top is provided with a cabinet under said table top with a cabinet under said table top.

13. The operating table as defined in claim 1, wherein said sink cover is provided at a top surface thereof with a hand grip fastened therewith.

14. The operating table as defined in claim 13, wherein said hand grip is a fixed hand grip.

15. The operating table as defined in claim 13, wherein said hand grip is a detachable hand grip.

* * * * *